US012498152B2

(12) United States Patent
Grzeszczak et al.

(10) Patent No.: US 12,498,152 B2
(45) Date of Patent: Dec. 16, 2025

(54) RECEIVER DRIER BOTTLE ASSEMBLY

(71) Applicant: Valeo Autosystemy Sp. z o.o., Skawina (PL)

(72) Inventors: Bartlomiej Grzeszczak, Skawina (PL); Natalia Ficek, Skawina (PL)

(73) Assignee: Valeo Autosystemy Sp. z o.o., Skawina (PL)

( * ) Notice: Subject to any disclaimer, the term of this patent is extended or adjusted under 35 U.S.C. 154(b) by 436 days.

(21) Appl. No.: 18/035,613

(22) PCT Filed: Oct. 21, 2021

(86) PCT No.: PCT/EP2021/079224
§ 371 (c)(1),
(2) Date: May 5, 2023

(87) PCT Pub. No.: WO2022/096279
PCT Pub. Date: May 12, 2022

(65) Prior Publication Data

US 2024/0011682 A1 Jan. 11, 2024

(30) Foreign Application Priority Data

Nov. 6, 2020 (EP) ..... 20461580

(51) Int. Cl.
*F25B 43/00* (2006.01)

(52) U.S. Cl.
CPC .... *F25B 43/003* (2013.01); *F25B 2339/0441* (2013.01); *F25B 2400/162* (2013.01)

(58) Field of Classification Search
CPC ..... F25B 2339/0441; F25B 2400/162; F25B 2500/01; F25B 43/003
See application file for complete search history.

(56) References Cited

U.S. PATENT DOCUMENTS 3,759,062 A * 9/1973 Wrenn ..... F17C 5/02 62/149
5,870,901 A * 2/1999 Kontos ..... F01P 3/20 62/238.3
2003/0121278 A1 7/2003 Ichimura et al.

FOREIGN PATENT DOCUMENTS

EP 2982892 A1 2/2016
JP H04-121562 A 4/1992
(Continued)

OTHER PUBLICATIONS

Office Action issued in counterpart Chinese Patent Application No. 202180079814.7, mailed Apr. 14, 2025 (10 pages).
(Continued)

*Primary Examiner* — Dirk R Bass
(74) *Attorney, Agent, or Firm* — Osha Bergman Watanabe & Burton LLP

(57) ABSTRACT

A receiver drier bottle assembly (100) includes a plug opening (10) and a screw opening (40) formed on a receiver drier bottle cover (20) to receive a plug (30) and a screw (50) respectively. The plug (30) is formed with a plug cutout (32) that has first threads (32*a*). The screw opening (40) is partially overlapping the plug opening (10) and extends to a screw-receiving bore (42). The screw-receiving bore (42) is complementary to the plug cutout (32) and is formed with second threads (42*a*). The screw (50) with external threads (52) formed thereon is disposed partially on the plug cutout (32) to engage with the first threads (32*a*) and partially on the screw opening (40) to engage with the second threads (42*a*). Accordingly, the screw (50) immobilizes the plug (30) when the screw (50) is inserted in the screw opening (40).

10 Claims, 5 Drawing Sheets

(56) References Cited

FOREIGN PATENT DOCUMENTS

| | | | |
|---|---|---|---|
| JP | H11-223422 | A | 8/1999 |
| KR | 2001-0000788 | U | 1/2001 |
| KR | 10-0684259 | B1 | 2/2007 |
| WO | 95/07831 | A1 | 3/1995 |

OTHER PUBLICATIONS

International Search Report and Written Opinion in corresponding International Application No. PCT/EP2021/079224, dated Feb. 2, 2022 (10 pages).

* cited by examiner

RECEIVER DRIER BOTTLE ASSEMBLY

The present invention relates to a receiver drier bottle assembly for a condenser, in particular for a vehicle Heating Ventilation and Air-Conditioning system.

Conventional air conditioning system, for example, air conditioning system for a vehicle cabin includes a condenser, an evaporator, an expansion device, a compressor and a heater. Generally, the conventional air conditioning system configured with an expansion valve is also configured with a receiver drier that is disposed in a high-pressure section of the air conditioning system/air conditioning loop. The receiver drier is usually located between a condenser and the expansion valve in the air conditioning loop. Generally, the condenser is configured with the receiver drier along an outlet side of the condenser, particularly, along a length of an outlet collector of a pair of collectors of the condenser. The receiver drier includes a tubular casing in the form of an airtight container referred to as receiver drier bottle with an inlet and an outlet. The inlet receives liquid refrigerant along with some uncondensed refrigerant, debris and incompressible moisture, if any, from a first pass defining a condensing section of the condenser via a first portion of the outlet collector. The outlet delivers the liquid refrigerant from which incompressible moisture and debris are removed, to a second pass defining the sub-cooling section of the condenser via a second section of the outlet collector, or to the rest of the refrigerant circuit.

Figure 1A:
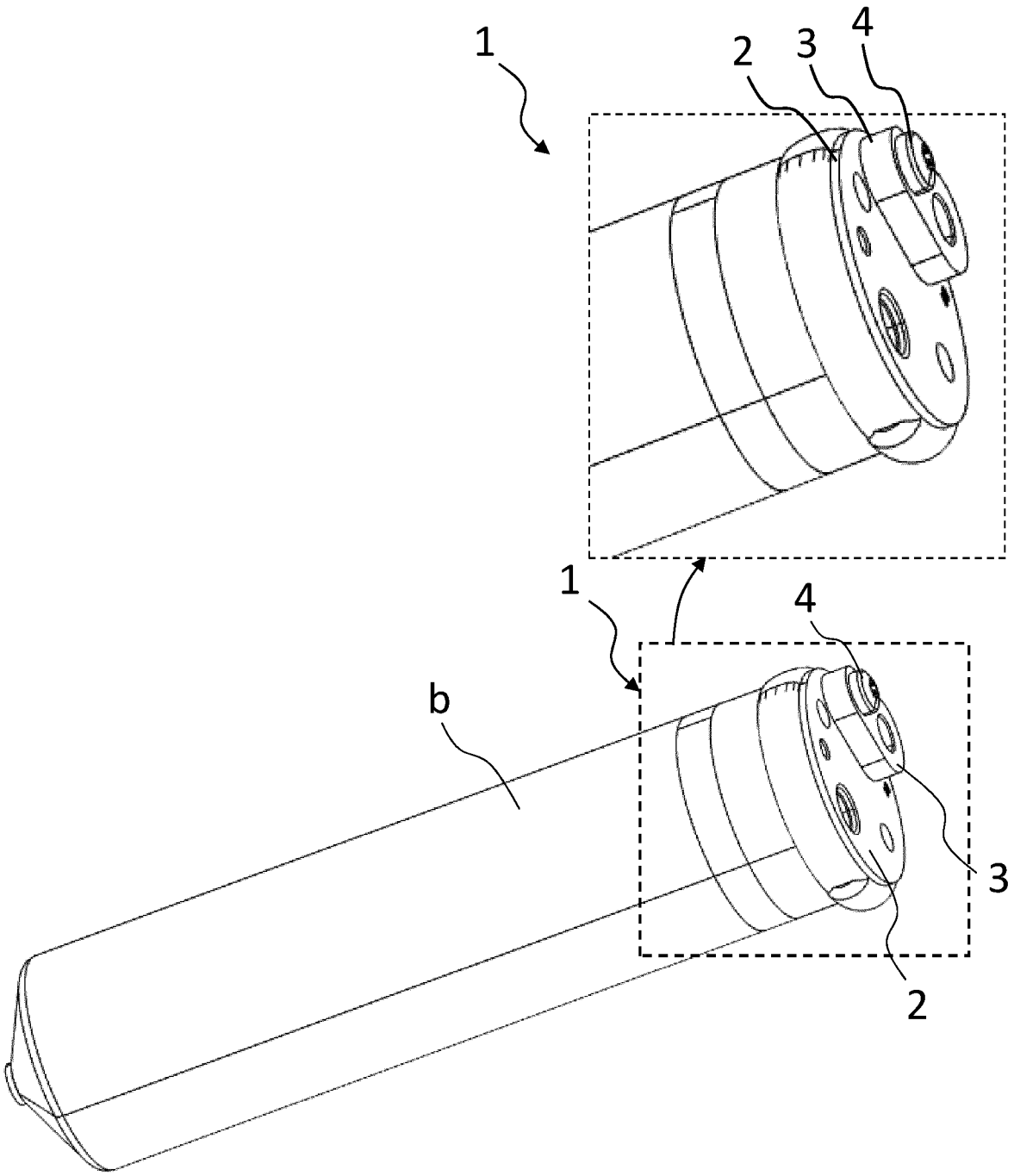
FIG. 1a (PRIOR ART)
Figure 1B:
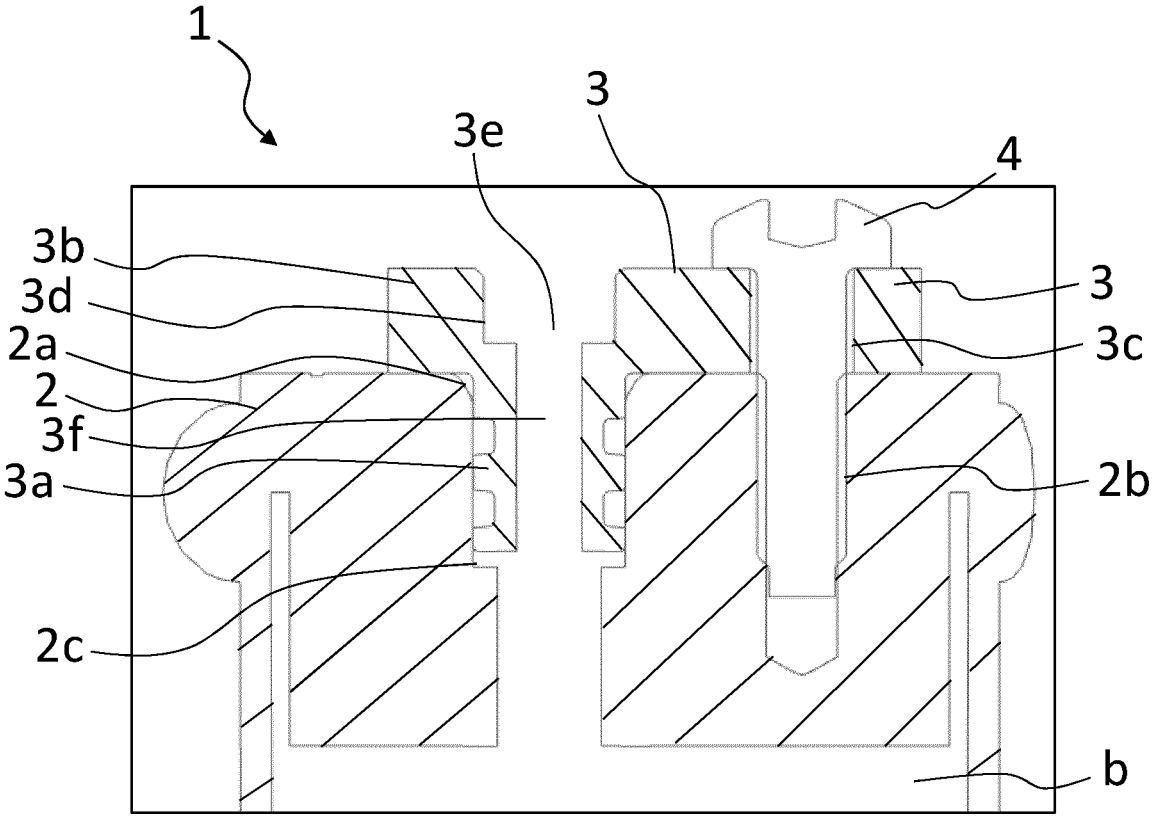
FIG. 1b (PRIOR ART)

As shown in FIGS. 1*a* and 1*b*, a condenser may be connected to the inlet and the outlet of the receiver drier via connecting pipes that configure fluid communication between the receiver drier and the outlet side of the condenser. Generally, a receiver drier bottle assembly 1 includes a cover 2 closing an end of the receiver drier bottle "b" and a connecting block 3 mounted on the cover 2. The connecting block 3 is mounted on the cover 2 using a bolt or screw 4. The connecting block 3 forms a connection and a fluid communication between the connecting pipe and the interior of the receiver drier bottle "b". The connecting block 3 includes a plug portion 3*a* and a flange portion 3*b* for configuring connection between the connecting block 3 and the cover 2. The plug portion 3*a* is plugged into a counter bore 2*c* extending from a plug opening 2*a* formed on the cover 2 and the flange portion 3*b* rests over the cover 2. In particular, a substantial portion of the connecting block 3 is disposed outside the receiver driver bottle "b".

The flange portion 3*b* includes a bolt-receiving hole 3*c* and a counter bore 3*d*. The bolt-receiving hole 3*c* is aligned with a corresponding complementary bore 2*b* formed on the cover 2 and the bolt 4 passes through the bolt-receiving hole 3*c* and the bore 2*b* aligned to each other to mount the flange portion 3*b* to the cover 2. The counter bore 3*d* forms connection and fluid communication between the connecting pipe "p" and an interior of the receiver drier bottle "b". Particularly, a large diameter bore 3*e* of the counter bore 3*d* receives the connecting pipe "p" while a small diameter bore 3*f* of the counter bore 3*d* extends through the plug portion 3*a* and is in fluid communication with the interior of the receiver drier bottle "b". However, with such configuration of the connecting block 3, substantial portion of the connecting block 3, i.e. the flange portion 3*b* is disposed outside the cover 2 and occupies substantial area of the cover 2. Accordingly, there is limited space on the cover 2 for mounting of other elements on the cover 2. Further, flange portion 3*b* mounted on the cover 2 intrudes into operating space of adjacent elements mounted on the cover 2, thereby resulting in packaging issues. Further, such configuration of the connecting block 3 increases overall mass of connecting pipe-cover assembly of the receiver drier bottle assembly 1 and involves notable machining, thereby increasing the overall cost. Further, such configuration involves aligning the cover and the connecting block that cause inconvenience in assembly. Also, with such configuration of the connecting pipe-cover assembly of the receiver drier bottle assembly, the connecting pipe "p" is comparatively far from a screw axis of the bolt 4, thereby resulting in mechanical failures due to the connecting pipe "p" exerting comparatively higher torque on the connecting block 3. Further, for mounting the connecting block 3 on the cover two separate holes, one bore 2*b* and one counter bore 2*c* are required to be formed on the cover 2, thereby causing stress concentrations and weakening of the cover 2.

Accordingly, there is a need for a receiver drier bottle assembly that obviates the problems faced by the conventional receiver drier bottle assembly. Particularly, there is a need for a receiver drier bottle assembly, wherein a connecting block forming connecting pipe-cover assembly addresses the mechanical failure issues by reducing torque exerted by a connecting pipe on the connecting block. Further, there is a need for a receiver drier bottle assembly that is comparatively inexpensive as a connecting block forming connecting pipe-cover assembly involves comparatively less material and less machining compared to the conventional connecting block. Furthermore, there is a need for a receiver drier bottle assembly, wherein a connecting block mounted on a cover of a receiver drier bottle is of compact configuration, thereby enabling mounting of additional elements on the cover. Further, there is a need for a receiver drier bottle assembly that is simple in construction and convenient to assemble.

An object of the present invention is to provide a receiver drier bottle assembly that obviates the problems faced by the conventional receiver drier bottle assembly.

Another object of the present invention is to provide a receiver drier bottle assembly, wherein a connecting block forming connecting pipe-cover assembly addresses the mechanical failure issues by reducing torque exerted by a connecting pipe on the connecting block Yet another object of the present invention is to provide a receiver drier bottle assembly that is comparatively inexpensive as a connecting block forming connecting pipe-cover assembly involves comparatively less material and less machining compared to the conventional connecting block Still another object of the present invention is to provide a receiver drier bottle assembly, wherein a connecting block mounted on a cover of a receiver drier bottle is of compact configuration, thereby enabling mounting of additional elements on the cover.

Further object of the present invention is to provide a receiver drier bottle assembly, wherein a connecting block mounted on a cover of a receiver drier bottle is of compact configuration and accordingly does not interfere with operation of other adjacent elements mounted on the cover.

In the present description, some elements or parameters may be indexed, such as a first element and a second element. In this case, unless stated otherwise, this indexation is only meant to differentiate and name elements which are similar but not identical. No idea of priority should be inferred from such indexation, as these terms may be switched without betraying the invention. Additionally, this indexation does not imply any order in mounting or use of the elements of the invention.

A receiver drier bottle assembly, hereinafter referred to as "assembly" is disclosed in accordance with an embodiment of the present disclosure. The receiver drier bottle assembly includes a plug opening and a screw opening formed on a cover and a plug and a screw received in the plug opening and the screw opening. The plug is formed with a plug cutout that has first threads. The screw opening is partially overlapping the plug opening and extends to a screw-receiving bore. The screw-receiving bore is complementary to the plug cutout and is formed with second threads. The screw with external threads formed thereon is disposed partially on the plug cutout to engage with the first threads and partially on the screw-receiving bore to engage with the second threads. Accordingly, the screw immobilizes the plug when the screw is inserted in the screw-receiving bore through the screw opening.

Preferably, the plug flushes with an external surface of the receiver drier bottle cover when inserted in the plug opening.

Alternatively, at least a portion of the plug remains above the external surface of the receiver drier bottle cover when inserted in the plug opening.

Otherwise, the plug is below the external surface of the receiver drier bottle cover when inserted in the plug opening.

Typically, the plug includes a head portion and a tube portion formed by impact extrusion.

In accordance with an embodiment, a base of the plug cutout and a bottom of the screw supported on the base are flat surfaces.

Alternatively, the bottom of the screw is conical and is supported on the base of the plug cutout that is complementary to the conical bottom of the screw.

Preferably, the bottom of the screw is hemi-spherical and is supported on the base of the plug cutout complementary to the hemi-spherical bottom of the screw.

Generally, the receiver drier bottle assembly includes a plurality of screws inserted in a plurality of the screw-receiving bores through respective screw openings disposed along periphery of the plug opening to immobilize different sides of the plug.

Figure 2A:
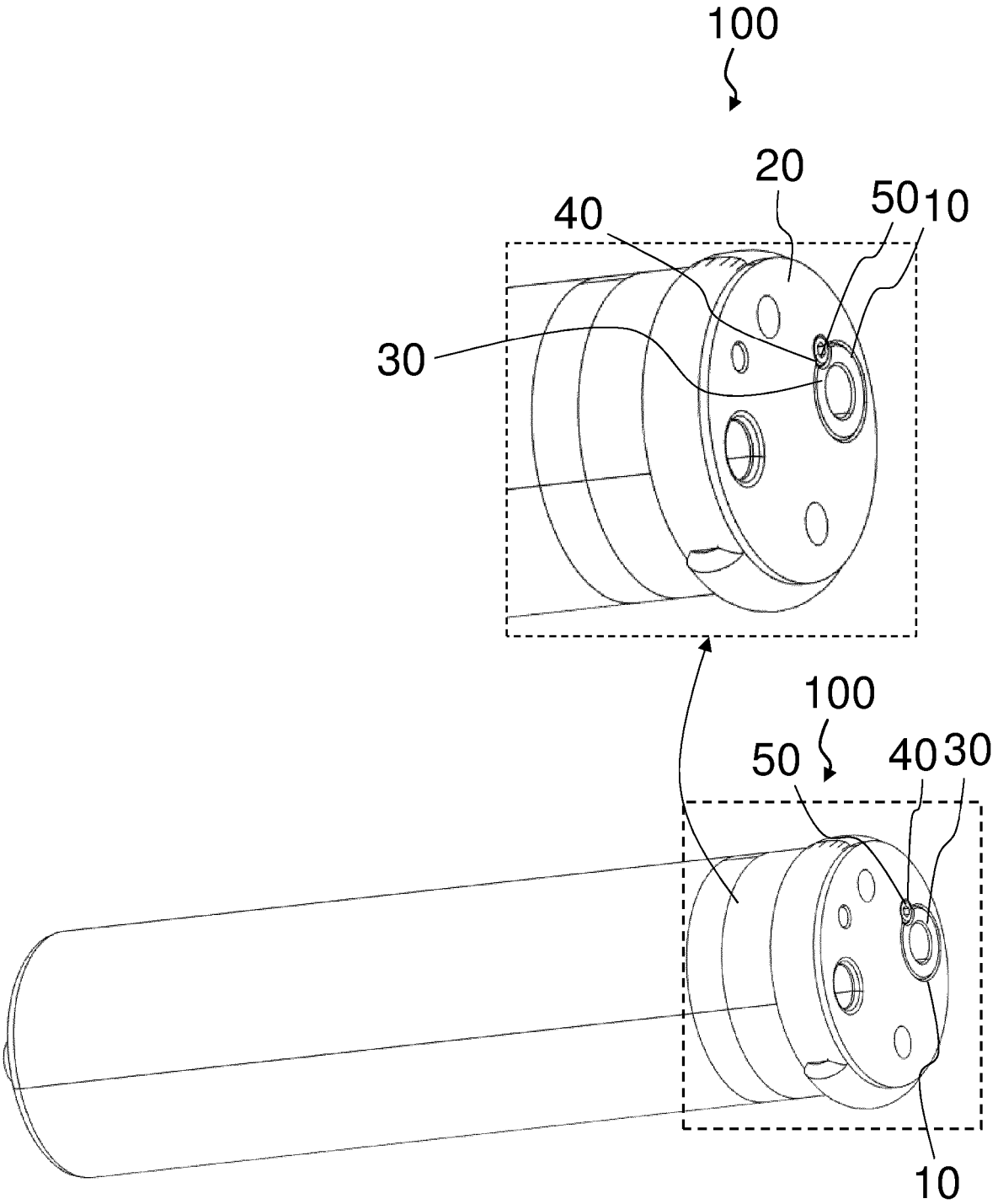
Figure 2B:
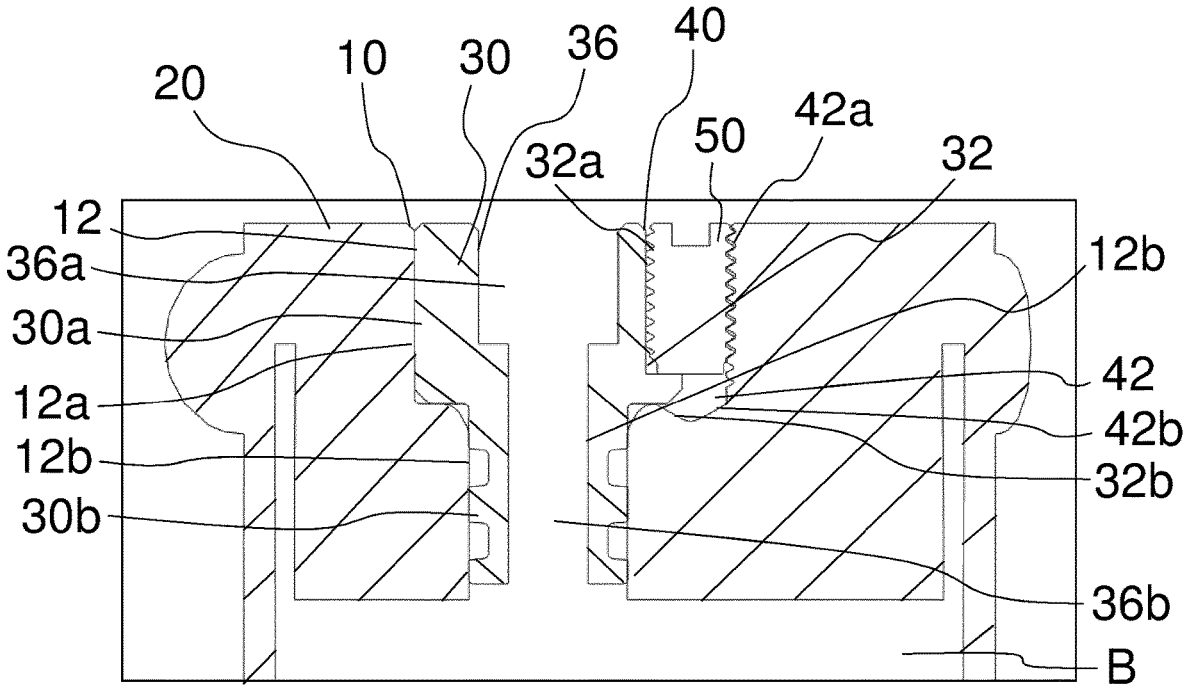
Figure 2C:
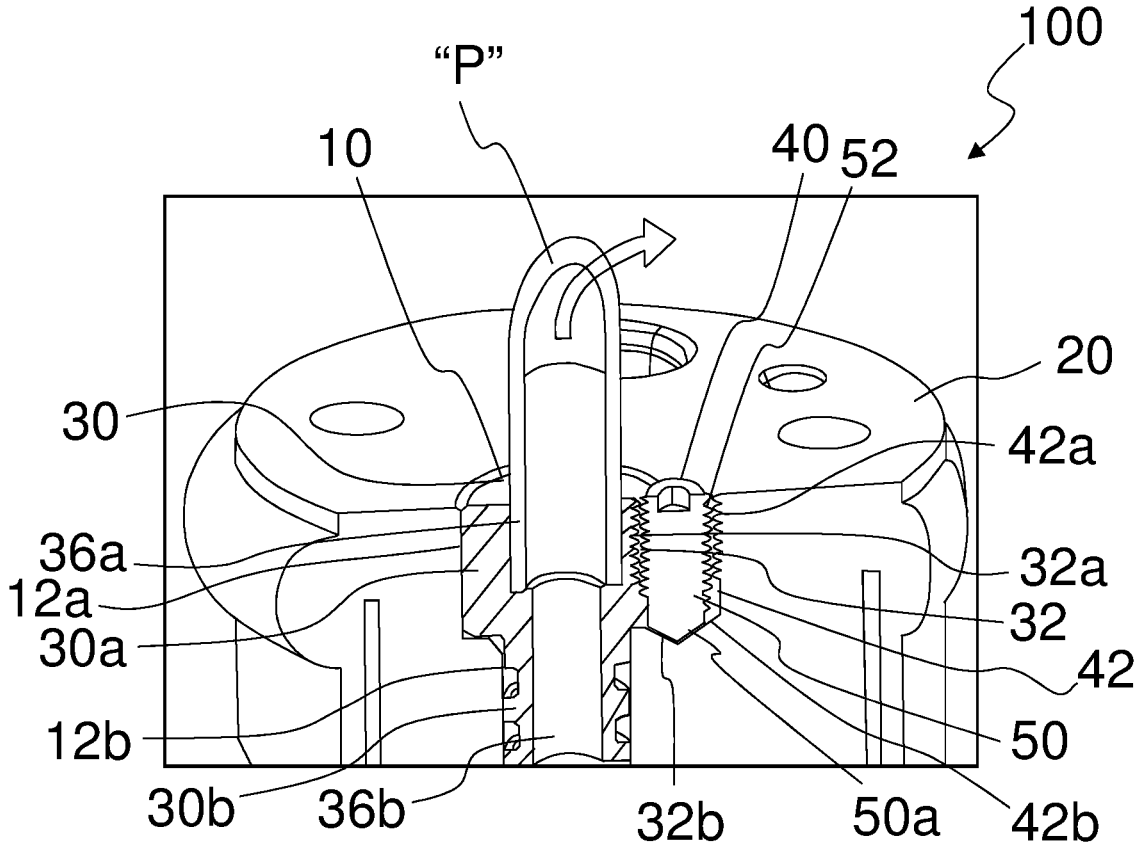

Other characteristics, details and advantages of the invention can be inferred from the description of the invention hereunder. A more complete appreciation of the invention and many of the attendant advantages thereof will be readily obtained as the same becomes better understood by reference to the following detailed description when considered in connection with the accompanying figures, wherein:

FIG. 1*a* illustrates an isometric view of a conventional receiver drier assembly, also is depicted an enlarged view of a cover-connecting block assembly thereof;

FIG. 1*b* illustrates a section view of the conventional receiver drier assembly of FIG. 1*a* depicting the internal details thereof;

FIG. 2*a* illustrates an isometric view of a receiver drier assembly of the present invention in accordance with an embodiment of the present invention, also is depicted an enlarged view of a cover-plug assembly thereof;

FIG. 2*b* illustrates a sectional view of the receiver drier assembly of FIG. 2*a* depicting the internal details thereof; and FIG. 2*c* illustrates another isometric sectional view of the receiver drier assembly of FIG. 2*a*.

The present invention relates to a receiver drier bottle assembly for a condenser of a vehicle Heating Ventilation and Air-conditioning system, wherein the receiver drier bottle assembly includes a plug opening formed on a receiver drier bottle cover, a plug received in the plug opening, a screw opening formed on a receiver drier bottle cover and a screw. The plug is formed with a plug cutout that has first threads. The screw opening partially overlapping the plug opening and complementary to the plug cutout include second threads. The screw with external threads formed thereon is disposed partially on the plug cutout to engage with the first threads and partially on the screw opening to engage with the second threads. Accordingly, the screw immobilizes the plug with respect to the receiver drier bottle when the screw is inserted in the screw opening. However, the present invention is not limited to receiver drier bottle assembly and is also applicable in any vehicular and non-vehicular applications, wherein a connecting block form connection and fluid communication between elements disposed on different sides of a cover for either element, without protruding out and without occupying much space of the cover.

A conventional receiver drier bottle assembly 1 includes a cover—connecting pipe assembly, wherein the cover—connecting pipe assembly includes a connecting block 3 mounted on a cover 2 of a receiver drier bottle "b". The connecting block 3 includes a plug portion 3*a* and a flange portion 3*b*. The plug portion 3*a* is received in the cover 2. The flange portion 3*b* is disposed outside the cover 2 and is mounted on the cover 2 by means of the bolt 4. The flange portion 3*b* occupies substantial area of the cover 2. Accordingly, there is limited space on the cover 2 for mounting of other elements on the cover 2. Further, the flange portion 3*b* of the connecting block 3 mounted on the cover 2 intrudes into operating space of adjacent elements mounted on the cover 2, thereby resulting in packaging issues. Further, such configuration of the connecting block 3 increases overall mass of connecting pipe-cover assembly of the receiver drier bottle assembly 1 and involves notable machining, thereby increasing the cost. Further, such configuration involves aligning the cover and the connecting block that cause inconvenience in assembly. Also, with such configuration of the connecting pipe-cover assembly of the receiver drier bottle assembly, the connecting pipe "p" is comparatively far from a screw axis of the bolt 4, thereby resulting in mechanical failures due to the connecting pipe "p" exerting comparatively higher torque on the connecting block 3. Further, for mounting the connecting block 3 on the cover two separate holes, one bore 2*b* and one counter bore 2*c* are required to be formed on the cover 2, thereby causing stress concentrations and weakening of the cover 2.

The present invention envisages a receiver drier bottle assembly that obviates the problems faced by the conventional receiver drier bottle assembly. The receiver drier bottle assembly of the present invention includes a plug received inside a cover of a receiver drier instead of a connecting block mounted on the cover and accordingly is of a compact configuration. Particularly, the connecting block flushes with an external surface of the receiver drier bottle cover when inserted in the plug opening. Accordingly allows mounting of other elements on the cover and does not interfere with operation of other adjacent elements mounted on the cover.

A receiver drier bottle includes a tubular casing with extreme ends thereof closed by respective covers to define an enclosure. The receiver drier includes a filter element and a desiccant material disposed inside the enclosure. The filter element traps debris that may have entered the air conditioning loop, whereas the desiccant material traps moisture carried with the condensate received from the condenser and prevents the moisture from reaching and harming other critical elements such as for example compressor disposed downstream of the condenser and receiver drier in the air conditioning loop.

FIG. 2*a* illustrates an isometric view of a receiver drier bottle assembly 100, hereinafter referred to as assembly 100 in accordance with an embodiment of the present invention. FIG. 2*b* illustrates a sectional view of the assembly 100 depicting the internal details thereof. FIG. 2*c* illustrates another isometric sectional view of the receiver drier assembly. The assembly 100 includes a plug opening 10 formed on a receiver drier bottle cover 20, hereinafter simply referred to as a cover 20, a plug 30, a screw opening 40 again formed on the cover 20 and a screw 50.

The cover 20 is either integrally formed to the tubular casing of the receiver drier or is threadably engaged to the extreme ends of the tubular casing of the receiver drier. Both inlet pipe for ingress of condensed refrigerant into the receiver drier bottle and the outlet pipe for egress of the condensed refrigerant out of the receiver drier bottle are connected to the cover 20. The plug opening 10 is formed on the cover 20. The screw opening 40 is also formed on the cover 20. The screw opening 40 is at least partially overlapping the plug opening 10. Apart from the plug opening 10 for configuring connection of the inlet pipe or the outlet pipe to the cover 20 and the screw opening 40 for mounting the plug 30 to the cover 20, other elements are also mounted on the cover 20. Particularly, the cover 20 includes other holes formed thereon to enable mounting of other elements on the cover 20. Considering limited space on the cover 20, all the elements mounted thereon are required to be of compact configuration to enable mounting of other elements without interfering with the adjacent elements. The plug opening 10 extends to a first counter bore 12 formed on the cover 20. The first counter bore 12 formed on the cover 20 includes a larger diameter 12*a* and a smaller diameter 12*b*.

The plug 30 is received in the first counter bore 12 through the plug opening 10. Preferably, top of the plug 30 flushes with an external surface of the cover 20 when the plug 30 is inserted into the first counter bore 12 through the plug opening 10. The plug opening 10 includes a chamfer along the periphery thereof. Further, the plug 30 includes a chamfer along periphery of the plug head to facilitate removal of the plug 30 from the plug opening 10. Alternatively, at least a portion of the plug 30 remains above the external surface of the cover 20 when the plug 30 is inserted in the counter bore 12 through the plug opening 10. More specifically, the plug 30 slightly extends above the external surface of the cover 20 when the plug 30 is inserted in the first counter bore 12 through the plug opening 10. In yet another embodiment of the present invention, the plug 30 is below the external surface of the cover 20 when the plug 30 is inserted in first counter bore 12 through the plug opening 10. The plug 30 includes a head portion 30*a* and a tube portion 30*b* formed by impact extrusion. The tube portion 30*b* includes external grooves that receive sealing elements, particularly O-rings to configure leak-proof engagement between the plug 30 and the first counter bore 12. The tube portion 30*b* of the plug 30 forms connection with the smaller diameter 12*b* of the first counter bore 12. More specifically, the plug 30 includes a second counter bore 36. The second counter bore 36 forms connection and fluid communication between the connecting pipe "P" and an interior of the receiver drier bottle "B". The second counter bore 36 includes a large diameter bore 36*a* and a small diameter through bore 36*b*. Particularly, the large diameter bore 36*a* formed on the head portion 30*a* of the second counter bore 36 receives the connecting pipe "P", whereas the small diameter bore 36*b* of the second counter bore 36 extends to and is in fluid communication with the interior of the receiver drier bottle "B". The plug 30 is formed with a plug cutout 32 that has first threads 32*a* formed on sidewalls of the plug cutout 32.

The screw opening 40 is partially overlapping the plug opening 10. The screw opening 40 extends to a screw-receiving bore 42 that is complementary to the plug cutout 32. The screw-receiving bore 42 includes second threads 42*a* formed on sidewalls thereof. The second threads 42*a* formed on sidewalls of the screw-receiving bore 42 are complementary to the first threads 32*a* formed on sidewalls of the plug cutout 32. The screw-receiving bore 42 is defined between sidewalls of the plug cutout 32 the complementary sidewalls of the screw opening 40. The screw opening 40 is provided with a chamfer along periphery thereof to facilitate removal of the screw 50 from the screw opening 40.

The screw 50 engages with the first and the second threads 32*a* and 42*a* on the sidewalls of the plug cutout 32 and the screw-receiving bore 42 respectively to immobilize the plug 30 with respect to the cover 20. Top of the screw 50 flushes with an external surface of the cover 20, when the screw 50 is received inside the screw-receiving bore 42 through the screw opening 40. The screw 50 engages with the first and the second threads 32*a* and 42*a* on the sidewalls of the plug cutout 32 and the screw-receiving bore 42 respectively to define deployed configuration of the screw 50. The screw head is flat and do not protrude outside the cover 20, when the screw 50 is in the deployed configuration. The screw head is provided with chamfer along periphery of the screw head to facilitate removal of the screw 50 from the screw opening 40. Generally, the screw 50 is a grub screw that is deployed and un-deployed using an Allen key that interacts with a corresponding hole. However, the present invention is not limited to any particular configuration of the screw and way of deployment and un-deployment of the screw 50 until the screw 50 remains inside the screw-receiving bore 42 formed on the cover 20 in the deployed configuration of the screw 50. The screw 50 with external threads 52 formed thereon is disposed partially on the plug cutout 32 to engage with the first threads 32*a* and partially on the screw-receiving bore 42 to engage with the second threads 42*a*. Accordingly, the screw 50 immobilizes the plug 30 with respect to the cover 20, when the screw 50 is inserted in the screw-receiving bore 42 through the screw opening 40. Instead of a single screw for mounting or immobilizing the plug 30 with respect to the cover 20, a plurality of screws 50 can be inserted in the screw-receiving bore 42 through the respective screw openings 40 disposed along periphery of the plug opening 10 to immobilize different sides of the plug 30. However, instead of the screw 50 engaging with the first and the second threads 32*a* and 42*a* formed on the sidewalls of the plug cutout 32 and the screw-receiving bore 42 respectively to immobilize the plug 30 with respect to the cover 20, another engagement element engaging with the sidewalls of the plug cutout 32 and the screw-receiving bore 42 can be used to immobilize the plug 30 with respect to the cover 20. More specifically, the present invention is not limited to any particular configuration of the engagement element, number and placement of the engagement element engaging with the sidewalls of the plug cutout 32 and the screw-receiving bore 42 to immobilize the plug 30 with respect to the cover 20.

The screw opening 40 is overlapping the plug opening 10. The screw opening extends to the screw-receiving bore 42, wherein the screw-receiving bore 42 is at least partially overlapping the first counter bore 12. Accordingly, the connecting pipe "P" received in the large diameter bore 36*a* of the plug 30 received in the plug opening 10 is proximal to mounting axis of the screw 50 received in the screw-receiving bore 42 through the screw opening 40 to mount the plug 30 to the cover 20. As such the Moment of force, specifically, the distorting torque acting on the plug 30 or the cover 20 is reduced. Accordingly, the mechanical failure issues arising due to torque exerted by the connecting pipe "P" on the plug 30 is reduced or prevented. Also with such configuration of the assembly 100, the stress concentration on the cover 20 is comparatively reduced compared to cover of the conventional assembly, wherein two separate holes are required to mount the connecting block to the cover. Also, with such configuration, the plug 30 and the screw 50 for mounting the plug 30 onto the cover 20 are disposed close to each other, thereby occupying comparatively lesser space of the cover 20 compared to conventional assembly. Accordingly, space is available for mounting additional elements on the cover 20 according to customer environment. Further, as the plug of the present invention is compact with respect to the conventional connecting block assembly, mass reduction and cost reducing is achieved. Also, the plug require comparatively less machining and is easier to machine compared to conventional connecting block, thereby further reducing the overall cost. Further, the plug of the present invention require a comparatively smaller screw for mounting the plug to the cover, thereby reducing the screw cost.

Generally, a bottom 50*a* of the screw 50 rests partially on a base 32*b* of the plug cut out 32 and partially on a base 42*b* of the screw-receiving bore 42. The base 32*b* of the plug cutout 32 and the bottom 50*a* of the screw 50 supported on the base 32*b* of the plug cut out 32 are flat surfaces. More specifically, the bottom 50*a* of the screw 50 rests on a complementary flat surface formed by the base 32*b* of the plug cutout 32 and the base 42*b* of the bore 42. Alternatively, the bottom 50*a* of the screw 50 is conical and is supported on the base 32*b* of the plug cutout 32 complementary to the conical bottom 50*a* of the screw 50. More specifically, the bottom 50*a* of the screw 50 rests on a complementary conical surface formed by the base 32*b* of the plug cutout 32 and the base 42*b* of the bore 42 disposed adjacent to each other. Preferably, the bottom 50*a* of the screw 50 is hemi-spherical and is supported on the base 32*b* of the plug cutout 32 complementary to the hemi-spherical bottom 50*a* of the screw 50. More specifically, the bottom 50*a* of the screw 50 rests on a complementary hemispherical surface formed by the base 32*b* of the plug cutout 32 and the base 42*b* of the bore 42 disposed adjacent to each other. With such configuration, extra material is available to reinforce the connection between the base 32*b* of the plug cutout 32 and sidewalls of the cutout 32, thereby increasing axial load bearing capacity of the base 32*b* of the plug cutout 32 due to axial load acting on the base 32*b*. Accordingly, the chances of mechanical failure of the plug is reduced and service life thereof is increased.

Several modifications and improvement might be applied by the person skilled in the art to the receiver drier bottle assembly as disclosed above and such modifications and improvements will still be considered within the scope and ambit of the present invention, as long as the receiver drier bottle assembly includes a plug opening, a plug, a screw opening and a screw. The plug is received in the plug opening. The plug is formed with a plug cutout that has first threads. The screw opening partially overlaps the plug opening and is complementary to the plug cutout. The screw opening has second threads. The screw with external threads formed thereon is disposed partially on the plug cutout to engage with the first threads and partially on the screw opening to engage with the second threads. Accordingly, the screw immobilizes the plug when the screw is inserted in the screw opening.

In any case, the invention cannot and should not be limited to the embodiments specifically described in this document, as other embodiments might exist. The invention shall spread to any equivalent means and any technically operating combination of means.

The invention claimed is:

1. A receiver drier bottle assembly comprising:

a plug opening formed on a receiver drier bottle cover;

a plug adapted to be received in the plug opening, the plug being formed with a plug cutout that has first threads;

a screw opening partially overlapping the plug opening and extending to a screw-receiving bore, the screw-receiving bore being complementary to the plug cutout and being formed with second threads; and a screw with external threads formed thereon which is disposed partially on the plug cutout to engage with the first threads and partially on the screw-receiving bore to engage with the second threads, the screw immobilizing the plug when the screw is inserted in the screw-receiving bore through the screw opening.

2. The receiver drier bottle assembly as claimed in claim 1, wherein the plug flushes with an external surface of the receiver drier bottle cover when inserted in the plug opening.

3. The receiver drier bottle assembly as claimed in claim 1, wherein at least a portion of the plug remains above the external surface of the receiver drier bottle cover when inserted in the plug opening.

4. The receiver drier bottle assembly as claimed in claim 1, wherein the plug is below the external surface of the receiver drier bottle cover when inserted in the plug opening.

5. The receiver drier bottle assembly as claimed in claim 1, wherein the plug comprises a head portion and a tube portion formed by impact extrusion.

6. The receiver drier bottle assembly as claimed in claim 1, wherein a base of the plug cutout and a bottom of the screw supported on the base are flat surfaces.

7. The receiver drier bottle assembly as claimed in claim 6, wherein the bottom of the screw is conical and is supported on the base of the plug cutout complementary to the conical bottom of the screw.

8. The receiver drier bottle assembly as claimed in claim 6, the bottom of the screw is hemi-spherical and is supported on the base of the plug cutout complementary to the hemi-spherical bottom of the screw.

9. The receiver drier bottle assembly as claimed in claim 1 further comprising: a plurality of screws inserted in a plurality of the screw-receiving bores through respective screw openings disposed along periphery of the plug opening to immobilize different sides of the plug.

10. A condenser assembly comprising the receiver drier bottle assembly according to claim 1.

* * * * *